US011892172B2

(12) United States Patent
Sun

(10) Patent No.: US 11,892,172 B2
(45) Date of Patent: Feb. 6, 2024

(54) BALANCED POLLUTANT CLEANING SYSTEM

(71) Applicant: Shanmin Sun, Qingyuan (CN)

(72) Inventor: Shanmin Sun, Qingyuan (CN)

( * ) Notice: Subject to any disclaimer, the term of this patent is extended or adjusted under 35 U.S.C. 154(b) by 659 days.

(21) Appl. No.: 17/055,979

(22) PCT Filed: Apr. 1, 2020

(86) PCT No.: PCT/CN2020/082808

§ 371 (c)(1),
(2) Date: Nov. 16, 2020

(87) PCT Pub. No.: WO2020/216030

PCT Pub. Date: Oct. 29, 2020

(65) Prior Publication Data

US 2021/0254838 A1 Aug. 19, 2021

(30) Foreign Application Priority Data

Apr. 22, 2019 (CN) ..... 201910325023.2

(51) Int. Cl.
*F24C 15/20* (2006.01)

(52) U.S. Cl.
CPC ..... *F24C 15/2021* (2013.01)

(58) Field of Classification Search
CPC ..... F24C 15/2021
USPC ..... 454/188–193; 126/299 D
See application file for complete search history.

(56) References Cited

U.S. PATENT DOCUMENTS

| | | | | |
|---|---|---|---|---|
| 7,699,051 | B2 | 4/2010 | Gagas et al. | |
| 2013/0220299 | A1* | 8/2013 | Lee | F24F 9/00 126/299 D |
| 2021/0025607 | A1* | 1/2021 | Torres | B08B 15/02 |

FOREIGN PATENT DOCUMENTS

| | | | |
|---|---|---|---|
| CN | 2128999 | | 3/1993 |
| CN | 1464230 | | 12/2003 |
| CN | 101936563 | A | 1/2011 |
| CN | 106123078 | | 11/2016 |
| CN | 108916932 | | 11/2018 |
| CN | 109945266 | A | 6/2019 |
| CN | 210267398 | U | 4/2020 |

* cited by examiner

*Primary Examiner* — Vivek K Shirsat
(74) *Attorney, Agent, or Firm* — Bayramoglu Law Offices LLC

(57) ABSTRACT

A balanced pollutant cleaning system is provided. The balanced pollutant cleaning system includes a fan, an air jet device, an air suction device and a control device. The air jet device is disposed around a shielded object and the air jet device is provided with a plurality of air jet ports, and an air inlet of the air jet device is connected with an air outlet of the fan through a pipeline. The air suction device is configured to suction away pollutants and heat generated by the shielded object and the air ejected from the air jet ports. The control device is configured to control a magnitude of an airflow output from the fan, and the control device is configured to adjust an air suction amount of the air suction device according to the magnitude of the airflow output from the fan.

7 Claims, 3 Drawing Sheets

BALANCED POLLUTANT CLEANING SYSTEM

CROSS-REFERENCE TO RELATED APPLICATIONS

This application is the national stage entry of International Application No. PCT/CN2020/082808, filed on Apr. 1, 2020, which is based upon and claims priority to Chinese Patent Application No. 201910325023.2, filed on Apr. 22, 2019, the entire contents of which are incorporated herein by reference.

TECHNICAL FIELD

Embodiments of the present application relate to the field of smoke collection devices, and in particular to a balanced pollutant cleaning system.

BACKGROUND

In daily life, air conditioners are installed in the living room and bedroom of the home, so that people will not be bothered by the heat in summer and the cold in winter. With the continuous improvement of the home environment and people's pursuit of perfect quality of life, the problem of installing air conditioners in kitchens has attracted more and more attention from people. At present, there is a huge market demand for air conditioners in kitchens, but there are not many real buyers. The reasons are worth deep pondering. For example, in the south, a working temperature in the kitchen averages over 33 degrees in summer from April to October. However, due to the large amount of oily smoke in the kitchen, the use effect and service life of the kitchen air conditioner are seriously affected. Since there is no barrier to the oily smoke and heat emitted from a stove top, the oily smoke and heat will still spread to other corners of the kitchen. Therefore, the diffusion of oily smoke and heat can be reduced only by increasing the power of a range hood, but this will further increase electrical power consumption and the effect is not significant. In addition, even if an air conditioner is installed in the kitchen, the range hood will exhaust a large amount of indoor cold air when it is working, and make hot outdoor air enter the kitchen through convection, causing the temperature in the kitchen to rise rapidly. Similarly, for a kitchen with the air conditioner operating in a heating mode in winter, because the range hood exhausts a large amount of hot air to the outside and the cold air enters the kitchen through convection, the temperature in the kitchen is rapidly reduced, and the kitchen is as cold as the outside. Therefore, the existing range hoods have a large influence on the internal temperature of the kitchen, and the kitchen air conditioner or heating equipment cannot perform its normal functions.

SUMMARY

To this end, embodiments of the present application provide a balanced pollutant cleaning system to solve the problems of low exhaust rate of oily smoke, high energy consumption, and large influence on the temperature in the kitchen in existing kitchen equipment.

In order to achieve the above object, an embodiment of the present application provides a balanced pollutant cleaning system, which includes:

a fan;

an air jet device, which is disposed around a shielded object and which is provided with a plurality of air jet ports, wherein an air inlet of the air jet device is connected with an air outlet of the fan through a pipeline, and when air is ejected from the air jet ports, the ejected airflow forms an air curtain around the shielded object;

an air suction device, which is disposed above the shielded object, and which is configured to suction away pollutants and heat generated by the shielded object and the air ejected from the air jet ports; and a control device, which is configured to control a magnitude of an airflow output from the fan, and adjust an air suction amount of the air suction device according to the magnitude of the airflow output from the fan.

Further, the air suction device is a range hood.

Further, the control device includes a control module, a gas flowmeter, a voltage controller, and a speed adjustment button, wherein the control module is electrically connected to the gas flowmeter, the voltage controller, the speed adjustment button, and a drive circuit board of the range hood respectively, and the voltage controller is electrically connected to the fan.

Further, the control module is a single-chip microcomputer.

Further, distances between two adjacent air jet ports are equal to each other.

Further, the shielded object is a gas stove.

Further, the model of the gas flowmeter is HQLUGB.

Further, the model of the single-chip microcomputer is STM8S103.

Embodiments of the present application have the following advantages:

1. In the balanced pollutant cleaning system of the embodiments of the present application, an air jet device is used to eject air, thereby forming an air curtain around the gas stove; the air curtain blocks the heat and oily smoke generated during cooking in the air curtain, which are finally discharged by the air suction device, so that the exhaust rate of heat and oily smoke is improved; at the same time, the oily smoke is effectively isolated from the chef by the air curtain, thus reducing the damage caused by the oily smoke to the chefs body.
2. In the balanced pollutant cleaning system of the embodiments of the present application, a control device controls a magnitude of an airflow output from the fan, and adjusts an air suction amount of the air suction device according to the magnitude of the airflow output from the fan, which can effectively reduce energy consumption; since the air in the air curtain is blocked from the air in the kitchen by the air curtain (the function of the air curtain is the same as that of an air curtain machine in a shopping mall), no matter whether the air conditioner is operating in a heating mode in winter or in a cooling mode in summer, the air in the kitchen will not be affected by the range hood (the cold air or warm air will not be suctioned away and discharged, and there is no need to add more cold air or warm air for supplement); therefore, the kitchen is more comfortable and energy-saving.

BRIEF DESCRIPTION OF THE DRAWINGS

The accompanying drawings that are required to be used in the description of the embodiments or the related art are described briefly below, so that the technical solutions according to the embodiments of the present application or according to the related art will become clearer. It is apparent that the accompanying drawings in the following description are only illustrative. For those skilled in the art, other accompanying drawings may also be obtained according to these drawings provided, without any creative work.

The structure, proportion, size and the like shown in the specification are only used to cooperate with the contents disclosed in the specification for those skilled in the art to understand and read, and are not intended to limit the conditions with which the present application can be implemented. Therefore, they have no practical significance in a technical sense. Any modification to the structure, any change of the proportions or any adjustment of the size should fall within the scope covered by the technical contents disclosed in the present application without influencing the effects and objects that can be achieved by the present application.

Description of reference signs: 10: fan; 20: air jet device; 30: air suction device; 50: shielded object; 21: hollow pipe; 22: air jet port; 41: control module; 42; gas flowmeter; 43: voltage controller; 44: speed adjustment button.

DETAILED DESCRIPTION OF THE EMBODIMENTS

The implementations of the present application will be described in the specific embodiments below, and other advantages and functions of the present application can be readily understood by those skilled in the art from the contents disclosed in the specification. It is apparent that the described embodiments are part of the embodiments of the present application, instead of all of them. All the other embodiments obtained by those skilled in the art on the basis of the embodiments of the present application without creative efforts will fall within the scope of protection of the present application.

Figure 1:
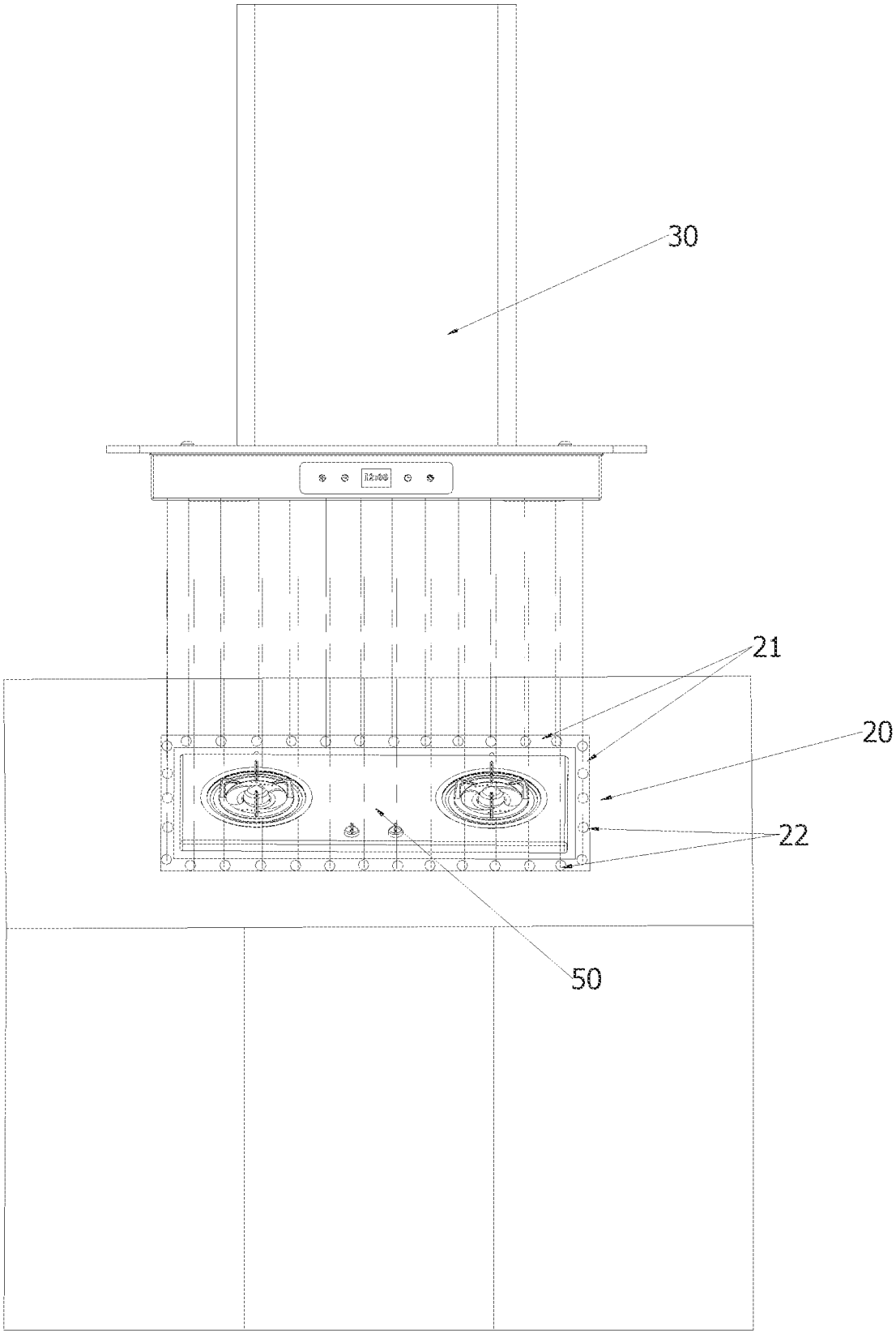
FIG. 1 is a schematic front view showing the structure of a balanced pollutant cleaning system provided by an embodiment of the present application.

As shown in FIG. 1, the balanced pollutant cleaning system includes a fan 10, an air jet device 20, an air suction device 30 and a control device. The fan 10 is configured to provide a stable airflow for the air jet device 20. The air jet device 20 of this embodiment is composed of four hollow pipes 21 connected end to end in sequence. The air jet device 20 is disposed around a shielded object 50. In this embodiment, the shielded object 50 is a gas stove, and the air jet device 20 is rectangular. Of course, the shape of the air jet device 20 is not limited to this, and is specifically determined according to the shape of the shielded object 50. Each of the hollow pipes 21 is provided with a plurality of air jet ports 22 on an outer peripheral face thereof. Preferably, distances between two adjacent air jet ports 22 are equal to each other. In this embodiment, one of the hollow pipes 21 is provided with an air inlet, and the air inlet is connected to an air outlet of the fan 10 through a pipeline. Of course, it is also possible to dispose an air inlet in each of the hollow pipes 21 and connect these air inlets to the air outlet of the fan 10 separately. Since the four hollow pipes 21 internally communicate with each other, internal pressures thereof are equal, so it is ensured that flow rates of the airflows ejected from individual air jet ports 22 are also equal to each other. When air is ejected from the air jet ports 22, the ejected airflow forms an air curtain around the gas stove.

Figure 2:
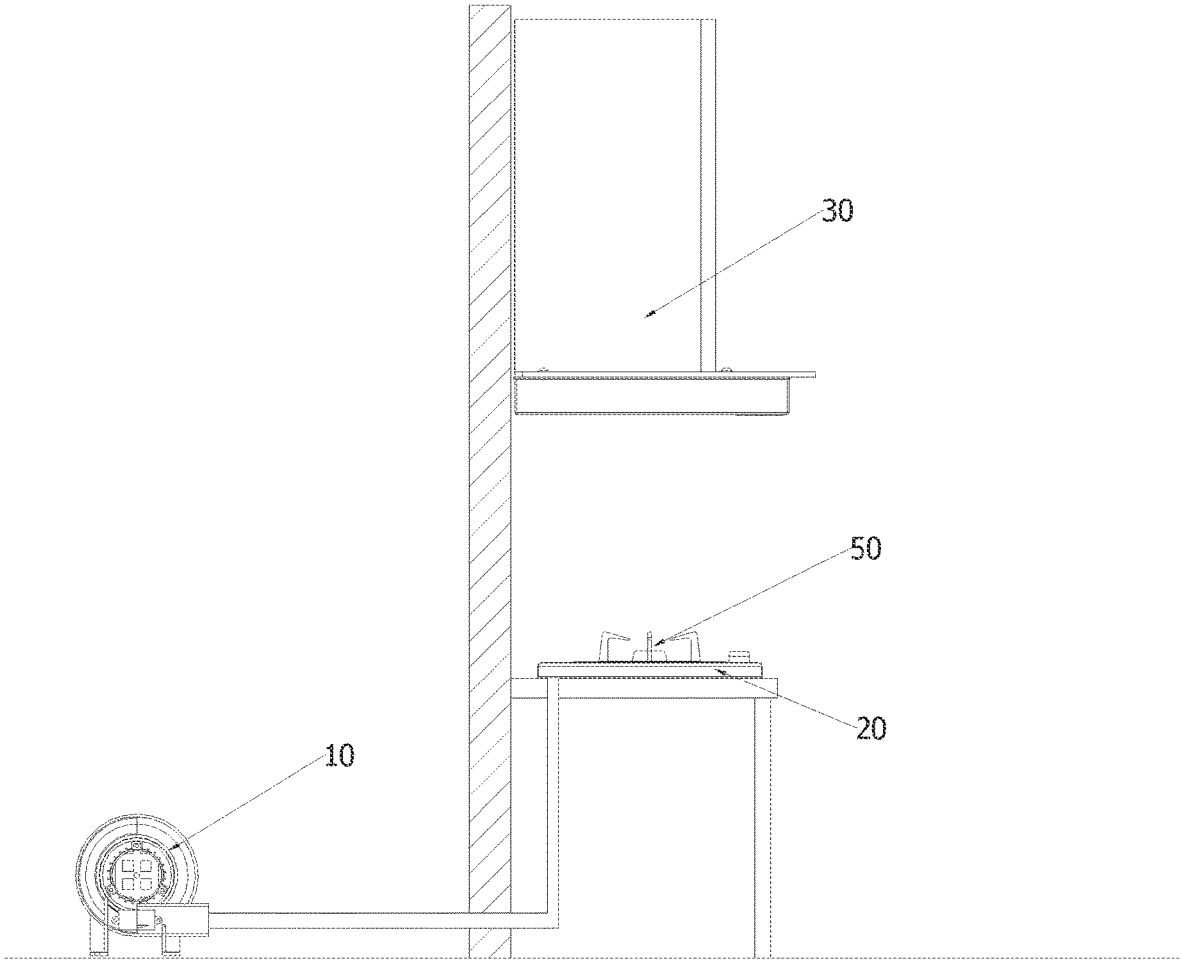
FIG. 2 is a schematic side view showing the structure of the balanced pollutant cleaning system provided by the embodiment of the application.

As shown in FIG. 2, the air suction device 30 is configured to suction away pollutants and heat generated by the shielded object 50, and the air ejected from the air jet ports 22. The air suction device 30 is disposed above the shielded object 50. In this embodiment, the air suction device 30 is a range hood, which is fixedly installed on a wall by bolts and is located directly above the gas stove. The size of the range hood is larger than an area enclosed by the air curtain to ensure that all the generated heat and oily smoke are suctioned away, so that the exhaust rate of the heat and oily smoke is improved.

Figure 3:
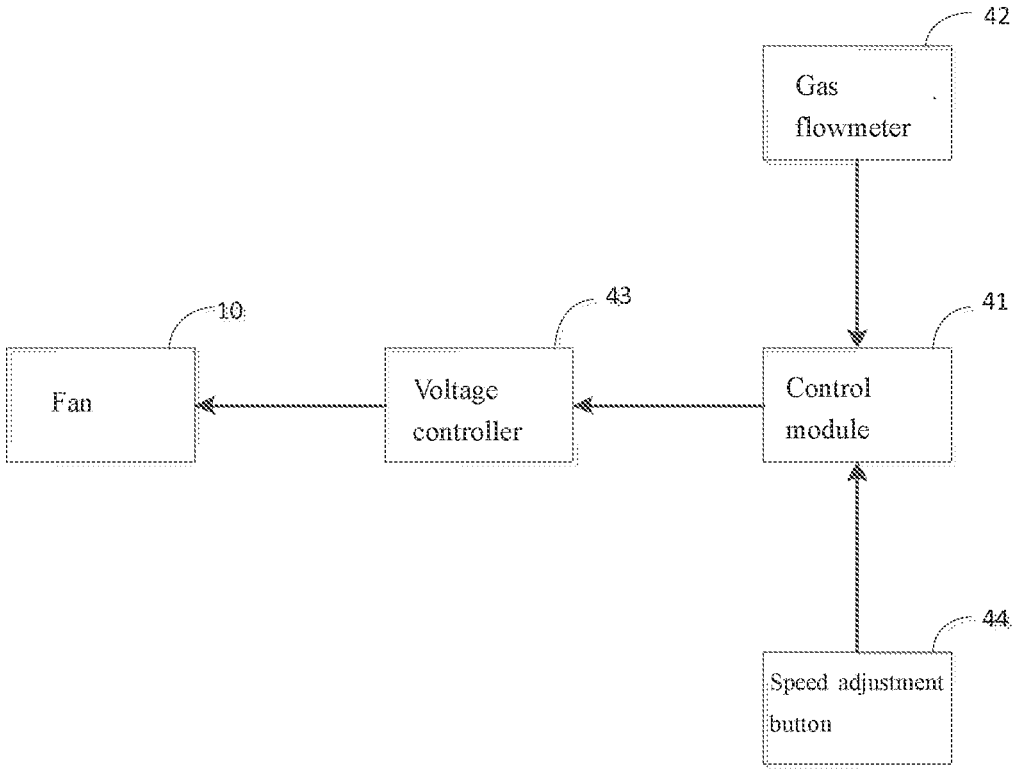
FIG. 3 is a schematic view showing the connection between a control module and other modules provided by the embodiment of the application.

As shown in FIG. 3, the control device is configured to control a magnitude of the airflow output from the fan 10, and adjust an air suction amount of the air suction device 30 according to the magnitude of the airflow output from the fan 10. The control device includes a control module 41, a gas flowmeter 42, a voltage controller 43, and a speed adjustment button 44, wherein the control module 41 is electrically connected to the gas flowmeter 42, the voltage controller 43, the speed adjustment button 44, and a drive circuit board of the range hood respectively, and the voltage controller 43 is electrically connected to the fan 10. The control module 41 is a single-chip microcomputer in this embodiment, and the model of the single-chip microcomputer is STM8S103. This type of single-chip microcomputer has good compatibility and can be compatible with drive circuit boards of most range hoods currently on the market. The gas flowmeter 42 is configured to measure the real-time flow rate of the airflow output from the fan 10, and convert it into an electrical signal to be sent to the control module 41. The gas flowmeter 42 is installed at the air outlet of the fan 10. The model of the gas flowmeter 42 in this embodiment is HQLUGB. The gas flowmeter 42 of this model has the advantages of high precision and small volume. The speed adjustment button 44 is configured to send a flow adjustment instruction to the control module 41. After receiving the flow adjustment instruction, the control module 41 sends a voltage adjustment instruction to the voltage controller 43. After receiving the voltage adjustment instruction, the voltage controller 43 changes an output power of the fan 10 by changing the voltage output to the fan 10, so that the magnitude of the airflow output from the fan 10 is changed.

During cooking, the fan 10 is turned on at the same time the range hood is turned on. The airflow output from the fan 10 is evenly ejected through each air jet port 22. The ejected airflow forms an air curtain around the gas stove to block the heat and oily smoke generated during cooking in the air curtain, which are finally discharged through the air suction device 30, thereby improving the exhaust rate of the heat and oily smoke. At the same time, the oily smoke is effectively isolated from the chef through the air curtain, and the damage caused by the oily smoke to the chef's body is reduced. During use, if the air curtain is not enough to completely block the oily smoke and heat generated by the gas stove, the speed adjustment button 44 can be used to increase the magnitude of the airflow ejected from the air jet ports 22, and the control module 41 can increase the air suction amount of the range hood according to the magnitude of the flow rate measured by the gas flowmeter 42, thus achieving a closed-loop control so that the heat and oily smoke are completely blocked in the air curtain. The control device controls the magnitude of the airflow output from the fan 10, and adjusts an air suction amount of the air suction device 30 according to the magnitude of the airflow output from the fan 10, which can effectively reduce energy consumption. Since the air in the air curtain is blocked from the air in the kitchen by the air curtain (the function of the air curtain is the same as that of an air curtain machine in a shopping mall), no matter whether the air conditioner is operating in a heating mode in winter or in a cooling mode in summer, the air in the kitchen will not be affected by the range hood (the cold air or warm air will not be suctioned away and discharged, and there is no need to add more cold air or warm air for supplement); therefore, the kitchen is more energy-saving.

While the present application has been described in detail with reference to the general description and specific embodiments above, it is apparent to those skilled in the art that some modifications or improvements may be made on the basis of the present application. Therefore, such modifications or improvements made without departing from the spirit of the present application will all fall within the scope of protection of the present application.

What is claimed is:

1. A balanced pollutant cleaning system, comprising:

a fan;

an air jet device, wherein the air jet device is disposed around a shielded object and the air jet device is provided with a plurality of air jet ports, wherein an air inlet of the air jet device is connected to an air outlet of the fan through a pipeline, and when air is ejected from the plurality of air jet ports, an ejected airflow forms an air curtain around the shielded object;

an air suction device, wherein the air suction device is disposed above the shielded object, and the air suction device is configured to suction away pollutants and heat generated by the shielded object and the air ejected from the plurality of air jet ports; and a control device, wherein the control device is configured to control a magnitude of an airflow output from the fan, and the control device is configured to adjust an air suction amount of the air suction device according to the magnitude of the airflow output from the fan, wherein the air suction device is a range hood, wherein the control device comprises a control module, a gas flowmeter, a voltage controller, and a speed adjustment button, wherein the control module is electrically connected to the gas flowmeter, the voltage controller, the speed adjustment button, and a drive circuit board of the range hood respectively, and the voltage controller is electrically connected to the fan.

2. The balanced pollutant cleaning system according to claim 1, wherein the control module is a single-chip microcomputer.

3. The balanced pollutant cleaning system according to claim 1, wherein distances between two adjacent air jet ports of the plurality of air jet ports are equal to each other.

4. The balanced pollutant cleaning system according to claim 3, wherein the shielded object is a gas stove.

5. The balanced pollutant cleaning system according to claim 2, wherein a model of the single-chip microcomputer is STM8S103.

6. The balanced pollutant cleaning system according to claim 5, wherein distances between two adjacent air jet ports of the plurality of air jet ports are equal to each other.

7. The balanced pollutant cleaning system according to claim 2, wherein distances between two adjacent air jet ports of the plurality of air jet ports are equal to each other.

* * * * *